US005609192A

United States Patent [19]

Anderson et al.

[11] Patent Number: 5,609,192

[45] Date of Patent: Mar. 11, 1997

[54] FUEL DISPENSER

[75] Inventors: Scott R. Anderson, Vancouver; Jesse S. Houle, New Westminster; David A. Besler, Burnaby; Andrew E. Loen, Port Alberni, all of Canada

[73] Assignee: Shell Oil Company, Houston, Tex.

[21] Appl. No.: 461,278

[22] Filed: Jun. 5, 1995

[51] Int. Cl.[6] ..... B67D 5/00

[52] U.S. Cl. ..... 141/208; 141/207; 141/94; 141/389; 141/352; 141/198

[58] Field of Search ..... 141/94–96, 198, 141/206–211, 214, 215, 217, 218, 351–353, 355, 382, 360–362, 387, 389

[56] References Cited

U.S. PATENT DOCUMENTS

| | | | |
|---|---|---|---|
| 3,580,414 | 5/1971 | Ginsburgh et al. | 220/86 |
| 3,783,913 | 1/1974 | Trusselle | 141/198 X |
| 3,881,528 | 5/1975 | Mackenzie | 141/208 X |
| 5,121,777 | 6/1992 | Leininger et al. | 141/207 |
| 5,131,441 | 7/1992 | Simpson et al. | 141/209 |
| 5,341,859 | 8/1994 | Howseman, Jr. | 141/198 |

*Primary Examiner*—J. Casimer Jacyna
*Attorney, Agent, or Firm*—Del S. Christensen

[57] ABSTRACT

A fuel dispensing nozzle and a method utilizing that dispensing nozzle, are provided, the method comprising the steps of: providing a sealing means effective to mate in a sealing relationship with a fuel tank inlet, the sealing means comprising a boot having an elastomeric sealing surface, a source of pressurized gas, a channel providing communication from the source of pressurized gas to outside of the boot wherein pressure on the elastomeric sealing surface restricts flow through the channel, and a means to block fuel flow through the fuel dispensing nozzle when a threshold pressure or greater exists at the source of gas supply, the threshold pressure indicative of a sealing relationship between the sealing surface of the boot and a fuel tank inlet; mating the sealing surface to the fuel tank inlet; and passing fuel into the fuel tank only when the pressure within the gas supply conduit exceeds the threshold pressure.

12 Claims, 2 Drawing Sheets

FUEL DISPENSER

FIELD OF INVENTION

This invention relates to a method and apparatus for dispensing a fluid such a gasoline.

BACKGROUND OF THE INVENTION

Gasoline refilling stations are typically equipped with vapor recovery systems to reduce emissions of hydrocarbon vapors during refilling of motor vehicles. Such systems vary in their details, but usually comprise a vapor line either concentric around a fuel line, or a second tube extending to near a fuel outlet nozzle, Vapors are drawn through the vapor line at a rate that can exceed the volumetric rate at which gasoline is pumped through the fuel line. A portion of the vapors removed from the vehicle's fuel tank are routed back to the fuel storage tank at the filling station to minimize the amount of vapor eventually vented to the atmosphere, and any vapors vented to the atmosphere are typically passed through an activated carbon filter.

It is also common for a fuel nozzle to be equipped with a seal that mates with a vehicle's fuel inlet to ensure that gasoline vapors do not escape from the fuel tank, and to provide a closer balance between the amount of vapor removed from the vehicle's fuel tank and the amount of vapor needed to maintain pressure in the fuel storage tank at the filling station.

Common problems with vapor recovery systems include overfilling of fuel tanks, resulting in liquids entering the vapor recovery system, and the difficulty of knowing when a seal between the fuel dispenser and the fuel tank inlet is achieved.

Numerous apparatuses have been proposed for preventing overfilling of fuel tanks during refuelling. The most common used method is an automatic cut-off within a dispenser nozzle. Typically this automatic cut-off uses a vapor path from the nozzle outlet back to a venturi around the fuel flow path within the nozzle. A sufficiently high pressure must be maintained at a point within this path to indicate that vapor is being drawn into the vapor path rather than liquids. When liquids enter the vapor path, the pressure drop in the path increases, and the pressure at the sensor point will decrease. When this pressure decreases below a threshold pressure, the fuel flow is cut-off, usually by a mechanical trip. When a vapor recovery nozzle that seals the fuel inlet is incorporated with a vacuum assist vapor recovery fuel dispenser, this automatic fuel cut-off will not function properly because pressure at the pressure sensor is subject to variations due to variations in the vapor recovery system. Such variations result in the shut-off not having sufficient consistency.

An electro-mechanical fuel cut-off switch is disclosed in U.S. Pat. No. 5,131,441. This switch incudes an electromagnetic clutch that enables the trigger of a nozzle to close. When fluids are detected by a fluid actuated switch located in the nozzle spout, electrical energy to the electromagnetic clutch is interrupted, and the fuel valve is closed. This mechanism is said to be quick-acting, and therefore minimizes splash-back losses to the environment. An optical liquid sensor is suggested as the fluid actuated switch. The fluid actuated switch is located within a baffled channel in the nozzle in the fuel dispenser of '441. The location of the switch within the baffled channel of the nozzle relies on the fluid level raising within the nozzle. Because vapor is trapped within the closed volume of the nozzle, liquid will not necessarily back-up in the nozzle, but could raise outside the nozzle and be drawn into the vapor recovery system. Liquids could therefore be exiting the fuel tank into the vapor recovery system before the fuel flow is cut off by the mechanism of patent '441.

Another fuel dispenser having a vapor recovery system is suggested in U.S. Pat. No. 5,121,777. This dispenser includes a flexible boot surrounding the fuel nozzle that encloses a vapor recover conduit. The flexible boot includes an electro-mechanical switch that must be closed as one of three requirements for the fuel flow to be enabled. The electro-mechanical switch is closed when the boot is compressed against a vehicle's fuel inlet nozzle. The electro-mechanical switch requires that an electrical contact be made within the fuel dispenser right at the mouth of the fuel tank. It would be preferable to have a system that does not require a electro-mechanical switch because such a switch can be unreliable, and because of the possibility that it could be a source of ignition.

It is therefore an object of the present invention to provide an apparatus and method using that apparatus wherein a determination that a sealing contact is made between the fuel dispenser and a fuel inlet of a vehicle without requiring a mechanical switch.

SUMMARY OF THE INVENTION

These and other objects of the present invention are achieved by a fuel dispensing nozzle and a method utilizing that dispensing nozzle, the method comprising the steps of: providing a sealing means effective to mate in a sealing relationship with a fuel tank inlet, the sealing means comprising a boot having an elastomeric sealing surface, a source of pressurized gas, a channel providing communication from the source of pressurized gas to outside of the boot wherein pressure on the elastomeric sealing surface restricts flow through the channel, and a means to block fuel flow through the fuel dispensing nozzle when a threshold pressure or greater exists at the source of gas supply, the threshold pressure indicative of a sealing relationship between the sealing surface of the boot and a fuel tank inlet; mating the sealing surface to the fuel tank inlet; and passing fuel into the fuel tank only when the pressure within the gas supply conduit exceeds the threshold pressure.

Existence of a sealing contact between a sealing surface of the fuel dispenser and a fuel inlet nozzle can be determined by providing a flexible flap parallel to the face of the sealing surface, and supplying a gas, such as air, to the inside of the flap. The back pressure on the air supplied to the flap indicates whether or not the sealing surface is effectively pressed against the fuel inlet to form a seal. When a sufficient back pressure is measured, the fueling process is permitted to proceed. A pressure switch may be provided on the gas supply conduit, or pneumatic logic could be used to provide a control signal. Thus, mechanical linkages within the fuel dispenser are avoided. This simplifies the dispenser, and improves reliability of the dispenser. The air channels through which gas passes are self-cleaning because of the positive pressure of gas.

The elastomeric boot preferably includes a conical insert that is not elastomeric inside of the sealing surface. This conical insert, being hard rather than elastomeric, is effective to center the sealing surfaces. The insert is preferably a hard plastic such as a nylon blend.

DESCRIPTION OF A PREFERRED EMBODIMENT

Figure 1:
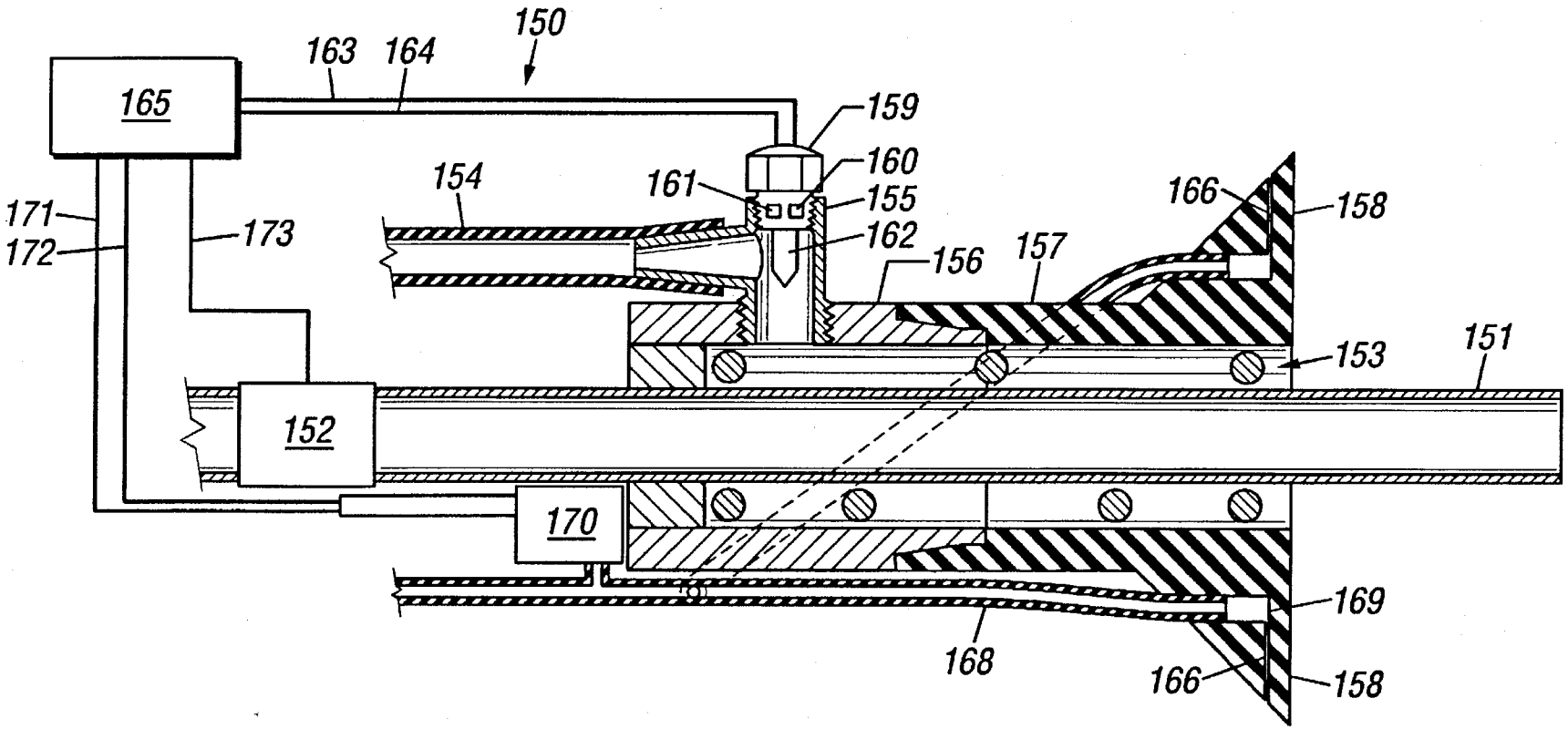
FIG. 1 is a schematic drawing of a system for the practice of the present invention.

Referring now to FIG. 1, a sketch of a fuel dispenser 150 according to the present invention is shown. A fuel conduit 151 supplies fuel into a tank to be refilled (not shown). A valve 152 is capable of shutting off fuel flow through the fuel conduit. A vapor recovery conduit 153 provides a path for removal of vapor from the fuel tank as liquid fuel is added. The vapor recovery conduit is shown as concentric around the fuel supply conduit. Other arrangements are acceptable, but a concentric arrangement is preferred. The concentric volume is in communication with a separate vacuum line 154 through a fitting 155. A rigid section 156 is shown surrounding a portion of the concentric vapor recovery conduit. The rigid section 156 also supports an elastomeric boot 157. The elastomeric boot has a sealing surface 158 that is capable of mating with an inlet of a fuel tank. The sealing surface is preferably concentric around both the vapor recovery conduit and the fuel supply conduit. The elastomeric boot can be molded from one of many known elastomeric materials such as vulcanized polybutadiene or silicone rubber. The sealing surface is shown as a flat surface having a round annular face perpendicular to the central axis of the fuel flow conduit, but an angled or rounded face that is partially inserted into the fuel tank inlet would also be acceptable. A sealing surface that is not flat could also be acceptable. In particular, the sealing surface could be formed to match a contour of a fuel tank inlet nozzle.

The fuel tank inlet could be an original manufacturer fuel tank inlet, or a fuel tank inlet that has been fitted with a modified fuel cap that provides for insertion of fuel nozzle through the fuel cap.

An optical liquid sensor 159 is shown placed within the vapor recovery conduit. The optical liquid sensor is preferably placed close to the sealing surface and elastomeric boot in order to result in a minimal amount of liquid being in the vapor recovery conduit when liquid is first detected by the optical liquid detector. The optical liquid detector can be one of the commercially available optical liquid detectors available from, for example, Cesco Electrical Supply Ltd. of Burnaby, British Columbia, and manufactured by Electromatic of Hadsten, Denmark. These sensors comprise a source of light, 160 such as infrared light, a photo cell light detector 161, and a reflector element 162. The reflector element may be, for example, a U shaped element, or a cylinder having a conical reflector end. The reflector element is fabricated from a material that has a high refractive index when compared to vapor, but not when compared to liquid such as polysulphone. The generated light therefore passes out of the reflector element when the reflector element is surrounded by liquid, but reflected by total internal reflection back to the photo cell when the reflector element is surrounded by vapor. The optical liquid sensor will generally require a power supply 163 and will generate a signal that can be transmitted through a signal cable 164. Both the power supply and the signal cable may be connected to a control unit 165. The control unit may be, for example, a simple logic chip within the handle of the fuel dispenser, or may be within a computer that controls the refuelling operation.

The optical liquid sensor of the present invention can be, and is preferably, used as a back-up to a primary system for preventing overfilling of a fuel tank by the fuel dispenser of the present invention. For example, a fuel supply cut-off disclosed in U.S. patent application Ser. No. 08/161,487 (incorporated herein by reference) could be used as a primary fuel supply cut-off, with the optical liquid sensor of the present invention providing a back-up to the primary fuel supply cut-off. The present optical liquid sensor is preferred as a back-up because it is preferable to discontinue fuel flow prior to liquids entering the vapor recovery conduit.

A slit 166 is provided near the face of the sealing surface. The slit 166 provides communication between the atmosphere surrounding the elastomeric boot (outside of the sealing surface) and a point within the elastomeric boot inside of the sealing surface. This slit is preferably between about 1/32 and about 1/4 of an inch from the sealing surface to ensure that a flap created by the slit exhibits sufficient flexibility to ensure that a minimal back pressure is created by gas flowing out the slit when the elastomeric boot is not in a sealing contact with another surface such as the inlet of a fuel tank. The slit can be of varying shapes, but a flat slit, parallel to the sealing surface, is convenient to provide. It is also convenient to provide this slit by cutting a molded elastomeric boot, but it could also be provided by gluing a thin flat elastomeric disk onto a boot that would also preferably, but not necessarily be elastic. This slit results in a flexible flap 167 extending across the sealing surface. A gas supply conduit 168 provides communication from a supply of gas (not shown) to a point within the slit inside of the sealing surface 169.

Using a positive pressure supply of gas to determine if a sealing contact exists has a significant advantage in that the slit will be purged constantly, and will therefore remain clean and dry.

The gas supply conduit 168 is also in communication with a pressure switch 170. The pressure switch determines if the back pressure on the gas supply conduit exceeds a threshold pressure that is indicative of a sealing contact being made between the sealing surface and an inlet of a fuel tank. The gas supply conduit may provide, for example, between about one one hundredth and about one tenth of a SCFM of air to the dispenser of the present invention, and the pressure switch may detect a threshold pressure of, for example, about four to about fifty inches of water. The threshold pressure will vary depending upon the volume of gas supplied to the slits, the smoothness of the slit, and distance and size of conduits that extend from the pressure sensor to the slit.

A preferred embodiment of the present invention utilizes pneumatic logic to directly utilize the back pressure on the supply conduit of gas to trigger a fuel supply shutdown. A pneumatic amplifier can be provided near the sealing surface, with an output from the amplifier used as a shutdown criteria for fuel flow through the fuel dispenser. In FIG. 1, this embodiment is represented by pressure switch 170 being a pneumatic amplifier with output 171 being an amplified signal to a control system. In a preferred embodiment, the amplified signal can go to a pneumatic "and gate", the output of which "and gate" controls the fuel supply valve 152. The output from the "and gate" supplies the pressure required to open the fuel valve. Other signals to the "and gate" may be, for example, a control signal from the control system, and/or a signal that confirms that a vapor recovery system is functioning.

The pressure sensor is preferably placed in close proximity to the dispenser to result in a wide range of acceptable threshold pressures. The length of conduit between the pressure sensor and the slit is preferably less than about six feet, and is more preferably between about one inch and about one foot.

The supply of gas will pass through the gas supply conduit and out the slit creating very little back pressure when the elastomeric boot is not in sealing contact with a surface such as a fuel tank inlet. When the sealing surface is in such sealing contact, a significant pressure will build up within the gas supply conduit. The threshold pressure indicative of a sealing contact can therefore be any pressure greater than the normal back pressure created by the flow of gas to the slit and out the slit when the sealing surface is not in a sealing contact and less than the supply pressure of the gas.

A plurality of slits are preferably provided in order to enable detection of a poor sealing contact on at least two sides of the elastomeric boot. More than three slits are not preferred because more than three slits increases the complexity of the apparatus without significantly benefiting the result. Of course, one slit could be provided that extends around the entire sealing surface, and the gas supply conduit, particularly if a thin piece of elastomeric material is glued to a boot around the inside of the sealing surface between the two to form the slit. If a thin piece of elastomeric material were attached to a boot in such a fashion to form a continuous slit around the sealing surface, the gas supply conduit could include a hollow ring within the boot, behind the thin piece of elastomeric material, so that a poor sealing contact at any point could create a path of relatively low resistance for the gas to escape, thus preventing the threshold pressure from existing at the pressure sensor.

The pressure sensor generates a signal indicative of the threshold pressure being detected, and communicates this signal to a control system by a conduit 171. The control system could provide power to the pressure sensor by a power conduit 172. The control system generates a signal to disenable the fuel flow when a sealing contact is not detected, or liquid in the vapor recovery conduit is detected. This disenabling means is shown in FIG. 1 as a valve in the fuel flow conduit that is closed upon receiving a signal from the control system. Conversely, the control system could enable fuel flow when a sealing contact is indicated by the pressure sensor.

Figure 2:
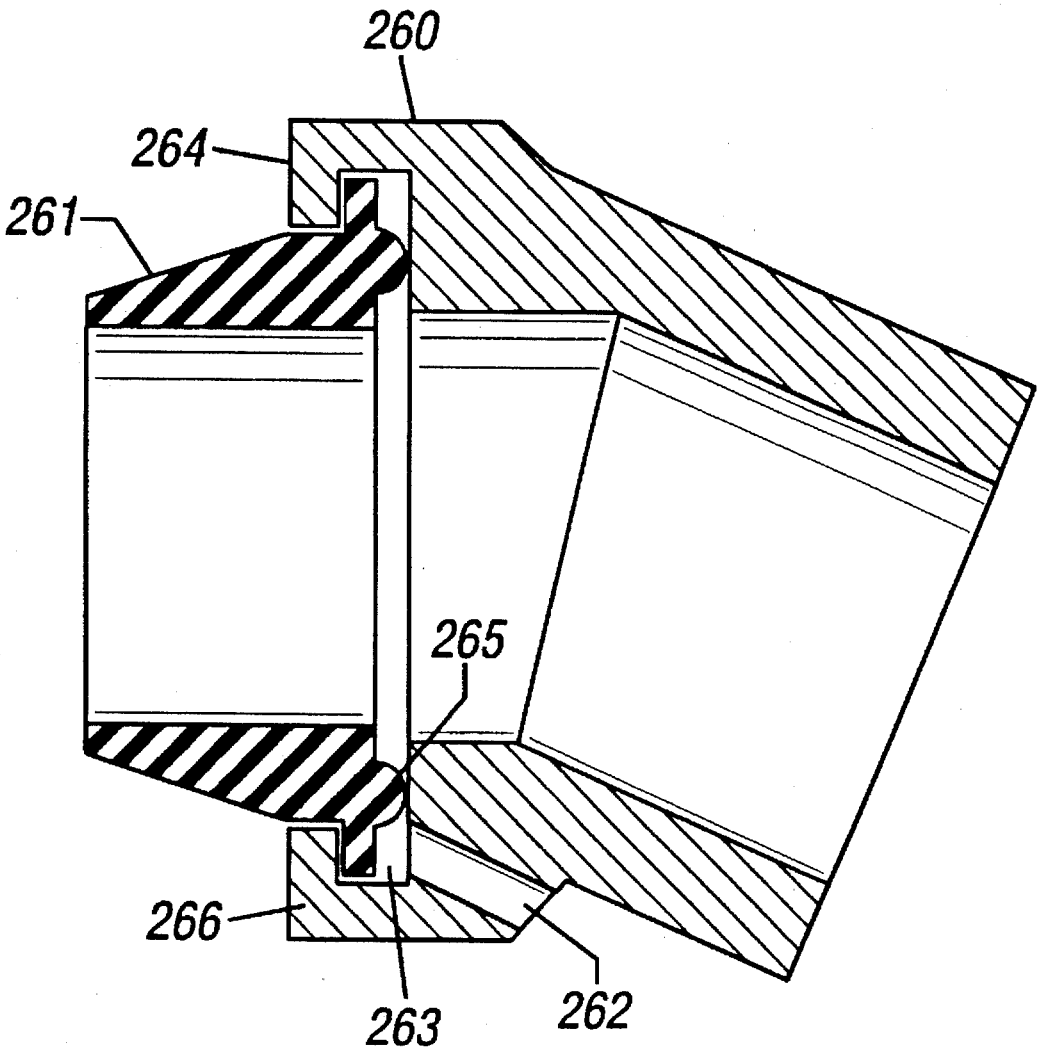
FIG. 2 is a cross sectional view of an elastomeric boot with a nonelastomeric insert according to a preferred embodiment of the present invention.

Referring now to FIG. 2, an alternative embodiment of a boot according to the present invention is shown. An elastomeric boot 260 with a hard non-elastomeric insert 261 is shown. The elastomeric boot has a seal surface 264 that forms a concentric annular circle around the hard insert 261. The hard insert provides a means to guide the boot onto a mating surface of a fuel inlet. An inlet for a supply of gas 262 is provided so that the existence of a sealing contact around the sealing surface can be determined. A gas such as compressed air enters a cavity 263 within the boot through the inlet 262 and, if a uniform pressure is being exerted on the sealing surface 264, will not escape. Thus, a significant back pressure is maintained on the supply of gas. When a uniform pressure is not being maintained on the sealing surface, the gas can escape past a raised ring 265 on the back side of the plastic insert, or between the insert 261 and an elastomeric flap 266 that forms the sealing surface. A low back pressure on the supply of gas therefore indicates that a sealing contact is not made. The embodiment of FIG. 2 can provide a 360° arc wherein a lack of contact can be detected.

Advantages of the embodiment of the present invention wherein a pneumatic amplifier and a pneumatic logic shutdown system is provided include a high level of simplicity and reliability, and that electrical connections within the fuel dispenser are avoided.

The method of the present invention is preferably practiced in connection with a vehicle refuelling system, but the method is broadly applicable to may other systems as can be seen by a person of skill in the art.

A preferred automated refuelling system for use with the method of the present invention is disclosed in U.S. patent application Ser. No. 08/461,280, incorporated herein by reference.

The previous descriptions of preferred embodiments are exemplary, and reference is made to the following claims to determine the full scope of the present invention.

We claim:

1. A method to refill a fuel tank, the method comprising the steps of:

providing a sealing means effective to mate in a sealing relationship with a fuel tank inlet, the sealing means comprising a boot having an elastomeric sealing surface, a source of pressurized gas, a channel providing communication from the source of pressurized gas to outside of the boot wherein pressure on the elastomeric sealing surface restricts flow through the channel, and a means to block fuel flow through the fuel dispensing nozzle and to allow fuel flow only when a threshold pressure or greater exists at the source of gas supply, the threshold pressure indicative of a sealing relationship between the sealing surface of the boot and a fuel tank inlet;

mating the sealing surface to the fuel tank inlet; and passing fuel into the fuel tank only when the pressure within the gas supply conduit exceeds the threshold pressure.

2. The method of claim 1 wherein the threshold pressure is a pressure of between about four and about fifty inches water pressure.

3. The method of claim 1 wherein the channel providing communication from the source of pressurized gas to outside of the boot is a slit in the elastomeric material forming the elastomeric seal.

4. The method of claim 3 wherein a plurality of such slits are provided around the circumference of the elastomeric boot.

5. The method of claim 1 wherein a non-elastomeric conical insert is provided inside of the sealing surface, the non-elastomeric insert effective to center the elastomeric sealing surface on a fuel inlet nozzle.

6. A fuel dispensing nozzle comprising:

a) a vapor recovery conduit effective to provide communication between a vapor space of a fuel tank to be refuelled and a system to remove vapors displaced by fuel added to the tank;

b) a fuel supply conduit;

c) a sealing means effective to mate in a sealing relationship with a fuel tank inlet, the sealing means comprising a boot having an elastomeric sealing surface, a source of pressurized gas, a channel providing communication from the source of pressurized gas to outside of the boot wherein pressure on the elastomeric sealing surface restricts flow through the channel; and d) a means to block fuel flow through the fuel dispensing nozzle and to allow fuel flow only when a threshold pressure or greater exists at the source of gas supply, the threshold pressure indicative of a sealing relationship between the sealing surface of the boot and a fuel tank inlet.

7. The fuel dispensing nozzle of claim 6 wherein the threshold pressure is a pressure of between about four and about fifty inches water pressure.

8. The fuel dispensing nozzle of claim 6 wherein the channel providing communication from the source of pressurized gas to outside of the boot is a slit in the elastomeric material forming the elastomeric seal.

9. The fuel dispensing nozzle of claim 8 wherein a plurality of such slits are provided around the circumference of the elastomeric boot.

10. The fuel dispensing nozzle of claim 6 wherein a non-elastomeric conical insert is provided inside of the sealing surface, the non-elastomeric insert effective to center the elastomeric sealing surface on a fuel inlet nozzle.

11. A fuel dispenser comprising:

a sealing means effective to mate in a sealing relationship with a fuel tank inlet, the sealing means comprising a boot having an elastomeric sealing surface, a source of pressurized gas, a channel providing communication from the source of pressurized gas to outside of the boot wherein pressure on the elastomeric sealing surface restricts flow through the channel; and a means to block fuel flow through the fuel dispensing nozzle and to allow fuel flow only when a threshold pressure or greater exists at the source of gas supply, the threshold pressure indicative of a sealing relationship between the sealing surface of the boot and a fuel tank inlet.

12. The fuel dispenser of claim 11 wherein the means to block fuel flow comprises a valve in the fuel dispenser capable of stopping fuel flow, and a pneumatic logic system, the pneumatic logic system comprising a pneumatic amplifier having as an input the source of pressurized gas, and as an output that, when the threshold pressure is reached, causes a valve in the fuel line to close.

* * * * *